US008590163B1

(12) United States Patent
Bagley et al.

(10) Patent No.: US 8,590,163 B1
(45) Date of Patent: Nov. 26, 2013

(54) ROTARY CUTTER GUARD AND SAFETY LIGHT ASSEMBLY

(75) Inventors: Jim Matthews Bagley, West Valley City, UT (US); Sergio Alejandro Ortiz-Gavin, Hollywood, CA (US)

(73) Assignee: Gracewood Sales, LLC, West Valley City, UT (US)

( * ) Notice: Subject to any disclaimer, the term of this patent is extended or adjusted under 35 U.S.C. 154(b) by 38 days.

(21) Appl. No.: 13/283,861

(22) Filed: Oct. 28, 2011

(51) Int. Cl.
*B26B 3/06* (2006.01)
*B26B 29/02* (2006.01)

(52) U.S. Cl.
USPC ..... 30/123; 30/153; 30/286; 30/151; 362/119

(58) Field of Classification Search
USPC ..... 30/2, 123, 151, 153, 286, 288, 292, 30/306, 307, 319, 329, 340; 362/119, 120; D7/694; D8/98
See application file for complete search history.

(56) References Cited

U.S. PATENT DOCUMENTS 1,991,121 A * 2/1935 Ross ..... 30/347
3,802,080 A * 4/1974 Peter ..... 30/292
4,062,116 A * 12/1977 Arnott ..... 30/292
4,301,594 A * 11/1981 Okada ..... 30/307
4,542,741 A * 9/1985 Burgin ..... 362/119
4,657,012 A * 4/1987 Burgin ..... 362/119
5,101,564 A * 4/1992 Melter ..... 30/292
5,299,355 A * 4/1994 Boda et al. ..... 30/292
5,355,588 A * 10/1994 Brandenburg et al. ..... 30/292
5,467,256 A * 11/1995 Chen ..... 362/119
5,493,781 A * 2/1996 Saito ..... 30/319
5,711,077 A * 1/1998 Schulz et al. ..... 30/319
5,727,319 A * 3/1998 Myerchin et al. ..... 362/119
5,765,289 A * 6/1998 Schulz et al. ..... 30/319
6,041,505 A * 3/2000 Chen ..... 30/123
6,044,565 A 4/2000 Arend et al.
6,189,218 B1 * 2/2001 Okada ..... 30/2
6,327,783 B1 * 12/2001 Ming ..... 30/286
6,419,371 B1 * 7/2002 McCalla et al. ..... 362/119
6,454,427 B1 * 9/2002 Chen ..... 362/119
6,460,254 B1 * 10/2002 Mori et al. ..... 30/286
6,643,936 B2 * 11/2003 Carlson et al. ..... 30/292
6,644,156 B2 11/2003 Villacis
7,008,076 B2 * 3/2006 Zirk et al. ..... 362/119
7,181,848 B1 * 2/2007 Tochtrop ..... 30/151
7,204,023 B2 * 4/2007 Chang ..... 30/319
7,363,710 B2 * 4/2008 Kortleven et al. ..... 30/319
D582,239 S * 12/2008 Eby et al. ..... D8/98
8,046,922 B2 * 11/2011 Eby et al. ..... 30/151
D664,824 S * 8/2012 Cunningham et al. ..... D8/98
2002/0138989 A1 10/2002 Kozyrski et al.
2004/0187318 A1 * 9/2004 Mathieu et al. ..... 30/319
2005/0028388 A1 * 2/2005 Liu ..... 30/319
2005/0086811 A1 * 4/2005 Kawasaki ..... 30/292
2007/0022615 A1 * 2/2007 Tsai-Lian ..... 30/319

(Continued)

*Primary Examiner* — Jason Daniel Prone
(74) *Attorney, Agent, or Firm* — J. David Nelson

(57) ABSTRACT

A hand-held, rotary fabric cutter having a handle, a blade assembly, a guard assembly, and a light assembly, the blade assembly and the guard assembly being attached to the handle by a blade bolt. The rotary cutter has a rotary blade and a longitudinally and laterally retractable blade guard attached to the handle by the blade bolt, the blade guard having a right guard and a left guard, the right guard and the left guard being pivotally connected by a guard pivot joint. The light assembly has a light element, an electric switch for the light element, a power source, and electrical interconnection. A slide knob simultaneously controls both the guard assembly and the light assembly.

9 Claims, 10 Drawing Sheets

(56) References Cited

U.S. PATENT DOCUMENTS

2008/0010839 A1* 1/2008 Eby et al. ..... 30/319
2008/0201960 A1 8/2008 Watanabe
2009/0116227 A1* 5/2009 Lin ..... 362/120
2011/0078908 A1 4/2011 Bagley
2011/0192034 A1* 8/2011 Holcomb et al. ..... 30/286

* cited by examiner

ROTARY CUTTER GUARD AND SAFETY LIGHT ASSEMBLY

FIELD OF THE INVENTION

This invention is in the field of devices for cutting fabric and in particular in the field of hand-held, rotary blade devices for cutting fabric.

BACKGROUND OF THE INVENTION

Rotary blade and hand-held fabric cutters are, hereinafter referred to as "rotary cutters" are known in the industry. They may be used in industrial, commercial or home settings for the cutting, usually of one or two layers of fabric at a time, and usually no more than a few layers. Rotary cutters provide for improved precision and speed compared to scissors and the like.

A typical rotary cutter, such as that shown in U.S. Patent Application 2008/0201960 by Watanabe and U.S. Patent Application No. 2011/0078908 by Bagley comprise an elongated handle shaped to enhance the stability of the user's hand grip, a transverse bolt affixed to the handle near one end of the handle, and a circular blade mounted on the bolt, thereby providing for the free rotation of the blade during a cutting operation. A rotary cutter is also typically provided with a lead guard of some sort to reduce the possibility of inadvertent injury to the user or others. Various types of guards have been devised, such as the divided guard of Watanabe which provides for one of two sub-member guards to be longitudinally retracted by operation of a slider knob and the guard of Bagley which laterally retracts when a guard release button is depressed and pressure is exerted on the cutting edge of the cutter for a cutting operation. The various blade guards that are provided for rotary cutters in the prior art have provided varying degrees of hand safety and varying degrees of user convenience and utility.

Lights have also been provided for use with rotary cutters, assisting in the viewing of the cut line during the cutting operation. The most notable are light units that are attachable to a rotary cutter and which are operated independently of the guard retraction mechanism.

It is an objective of the present invention to provide a longitudinally and laterally retracting guard which exposes all of the available cutting edge of the rotary blade, providing ready flexibility to the user in the direction of the cut and the hand to be used to make the cut with the cutter. It is a further objective of the present invention to provide a rotary cutter light system which serves a dual purpose of illuminating the cut area on the fabric and informs the user that the blade guard has been retracted.

SUMMARY OF THE INVENTION

A preferred embodiment of the rotary cutter of the present invention has a handle, a blade assembly, a guard assembly, and a light assembly, the blade assembly and the guard assembly being attached to the handle by a blade bolt. A slide knob is used by a user to control both the guard assembly and the light assembly.

The guard assembly has a guard stem and a blade guard. The guard stem has a pair of stem knobs, a left stem knob and a right stem knob. The blade guard has a left guard and a right guard, which are pivotally connected by a guard pivot joint. The blade guard is secured to the guard stem by insertion of the left stem knob in a left guard track in the left guard and insertion of the right stem knob in a right guard track in the right guard.

With the blade guard in the guard configuration, the guard perimeter extends beyond the rotary blade perimeter. As the user slides the slide knob upwardly in a slide knob groove which extends through the handle shell, the inside surface of the left guard and the right guard respectively contact a bolt sleeve collar, which projects from and is an interior surface feature and a part of the handle interior surface, and which rotates the left guard and the right guard respectively outwardly, effecting guard expansion, the left guard and the right guard pivoting with respect to each other at the guard pivot joint. The guard stem slides in a stem track in the handle cavity. Guard stem upward movement of the guard stem is limited by contact of the guard stem top with the bolt sleeve collar which extends from the handle interior surface of the handle rear. The left guard and the right guard are further urged to the guard's secure configuration by guard pegs, which are interior surface features of the handle interior surface and extend from the handle rear of the handle interior surface and press on rear track bases of a rear guard track, the rear track bases having a rear track base slope, further urging the guard expansion as the guard assembly is moved to the guard configuration. The positioning of the stem knobs in their respective guard track notches provides additional resistance and security of the guard against retraction in the event of inadvertent pressure against the guard.

As the user begins sliding the slide knob in the slide knob groove down toward the slide knob unguarded position, to retract the blade guard, the first movement of the guard stem results in the movement of the stem knobs from the guard track notches. Further downward movement of the guard stem results in downward movement of the blade guard as well. The downward movement of the blade guard results in the contact of the left guard base with the left handle shoulder of the handle interior surface and the right guard base with the right handle shoulder of the handle interior surface. Further downward movement of the slide knob and hence the guard stem to the fully retracted position results in the lateral retraction as well as the longitudinal retraction of the blade guard. The contact between the left guard base and the left handle shoulder, and between the right guard base and the right handle shoulder results in the pivoting of the left guard and the right guard at the guard pivot joint, and the movement of the left stem knob in the left guard track to the left track end and the movement of the right stem knob in the right guard track to the right track end.

A light assembly also may be incorporated in the rotary cutter. The primary components of a preferred embodiment of the light assembly are a light element, an electric switch for the light element, a mechanical switch engaged by the user to activate and deactivate the electric switch and thereby turn the light element on and off, a power source, and electrical interconnection between the power source, the electric switch and the light element. The light assembly is generally housed in the handle cavity. The power source may be a battery pack with replaceable or rechargeable batteries built into the handle cavity of the cutter handle. A remote battery pack or a power cord may also be used.

For a preferred embodiment, the mechanical switch incorporates the slide knob which, when slid by the user from the light off position, which is also the position of the slide knob when the blade guard is in the guard configuration, causes the electric switch to electrically connect the battery pack to the light element through the electrical interconnection, thereby providing power to the electric switch turning and thereby energizing the light element.

The positioning of the light element in the blade and guard chamber of the handle provides for light emitted from the light element to emanate to the fabric surface that the user intends to cut when the cutter is placed by the user in the normal cutting position. Light emanates to the fabric surface, regardless of which hand the cutter is being held in by the user and regardless of which side of the cutter is nearest the fabric during the cutting operation. The position of the light element also protects the light element from damage during the cutting operation. An additional safety benefit can also be achieved through the addition of a transparent or translucent blade guide. Light emitted from the light element illuminates the blade guide which transmits and disburses some of the light emitted by the light element, thereby providing a visible warning to the user that the guard has been retracted. Further safety features may be incorporated, such as a motion sensor, timing element and a flasher, providing for the light element to blink on and off if the light element having been left energized for a pre-determined time interval and no movement of the rotary cutter having occurred for a selected time interval, indicating that the cutter may have been set aside with the guard retracted and the light element energized.

DETAILED DESCRIPTION OF PREFERRED EMBODIMENTS

Figure 1:
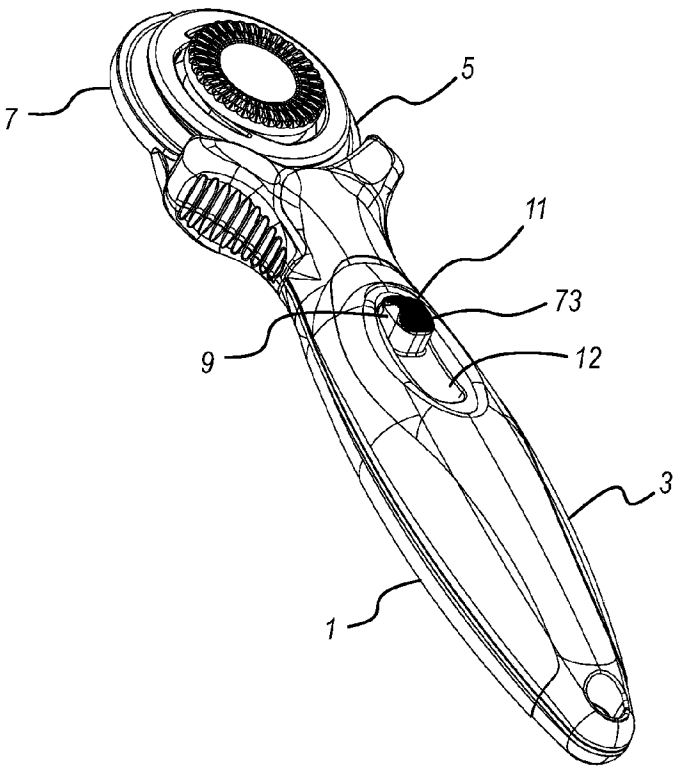
FIG. 1 is a front perspective view of a preferred embodiment of a fully assembled rotary cutter of the present invention.

Referring first to FIG. 1, a front perspective view of a fully assembled rotary cutter 1 of a preferred embodiment of the present invention is shown. The preferred embodiment shown has a handle 3, a blade assembly 5, a guard assembly 7 and a light assembly 9. The slide knob 11 is used by a user to control both the guard assembly 5 and the light assembly 7 for the embodiment shown.

Figure 2:
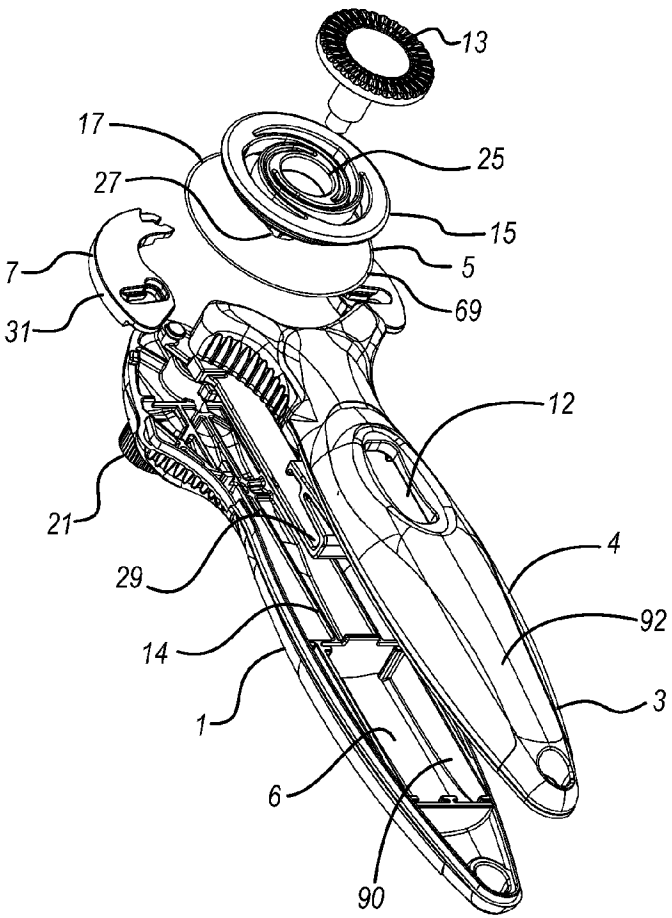
FIG. 2 is a front perspective exploded view of a preferred embodiment of a rotary cutter of the present invention.
Figure 3:
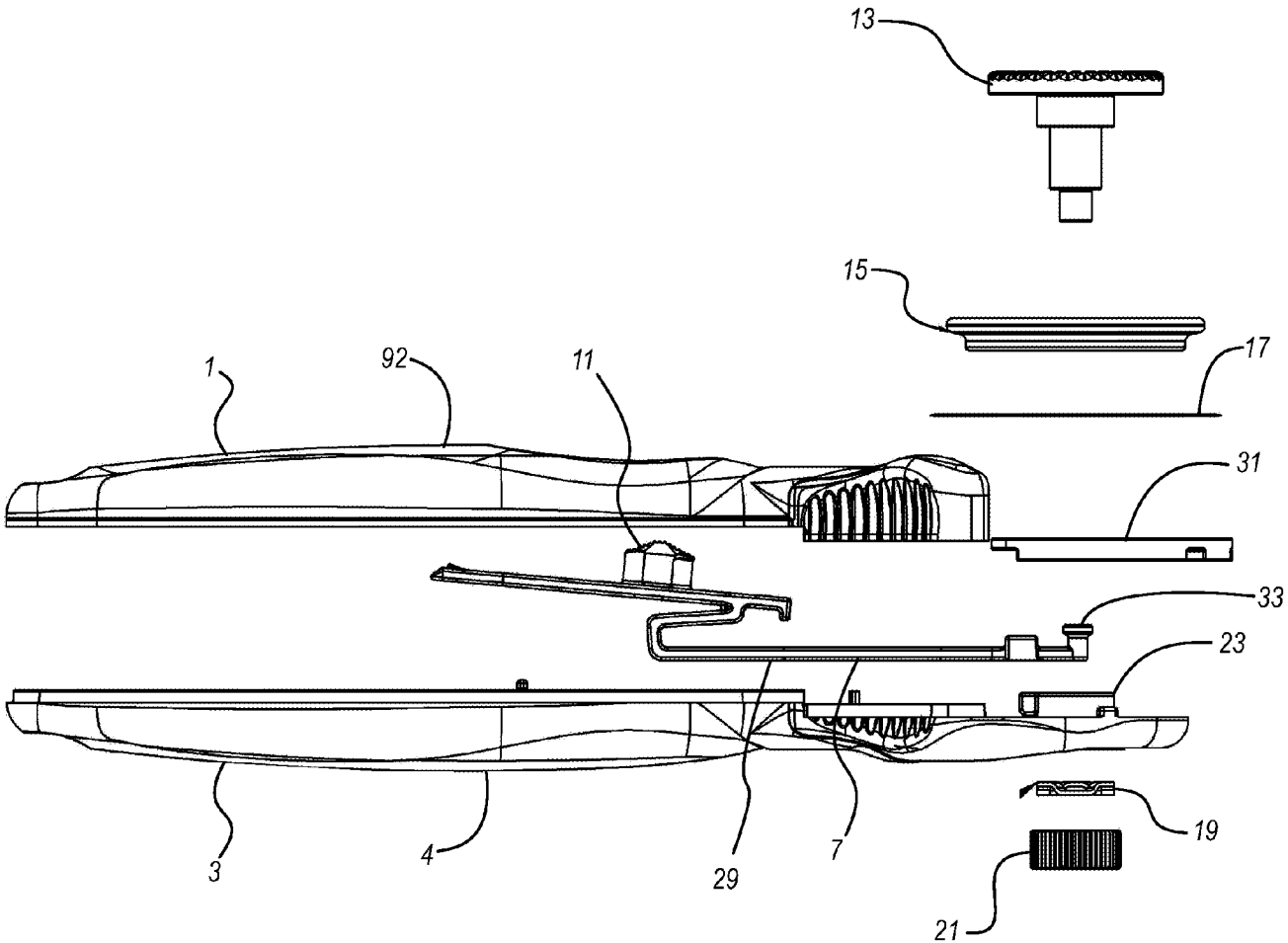
FIG. 3 is an exploded side view of a preferred embodiment of a rotary cutter of the present invention.

Referring now to FIG. 2, a front perspective exploded view of the rotary cutter of FIG. 1, and to FIG. 3, an exploded side view of the rotary cutter 1, the blade assembly 5 of the embodiment shown has a blade bolt 13, a blade guide 15, a rotary blade 17, a lock washer 19, and a bolt nut 21. The blade bolt 13 passes through the guide sleeve 25 in the blade guide 15, the blade sleeve 27 in the rotary blade 17, and the handle bolt sleeve 23 and is secured to the handle 3 by lock washer 19 and bolt nut 21. The handle 3 is generally hollow, consisting of a handle shell 4 enclosing a handle cavity 6, the handle having a handle interior surface 90 and a handle exterior surface 92.

Figure 5:
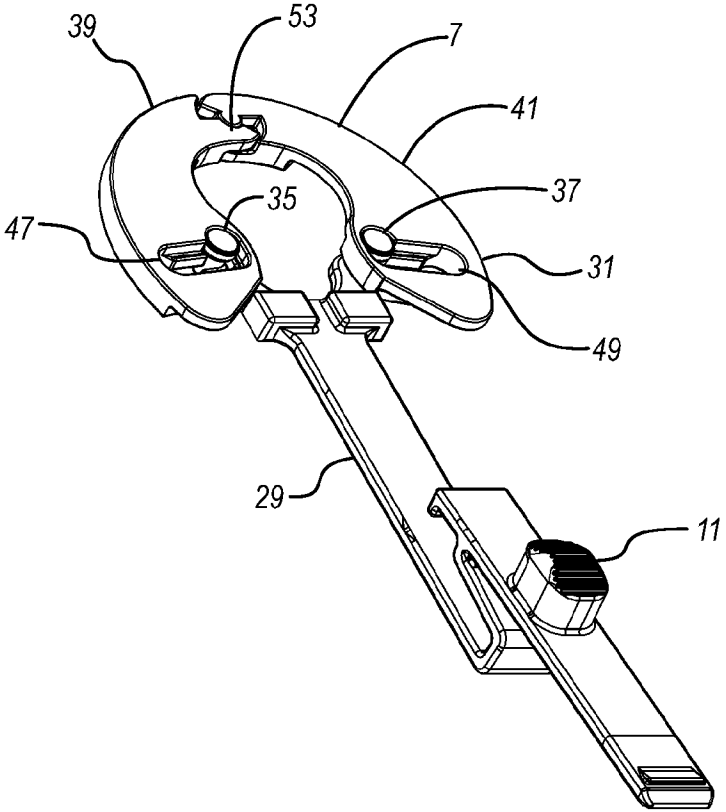
FIG. 5 is a fully assembled guard assembly of a preferred embodiment of a rotary cutter of the present invention.
Figure 4:
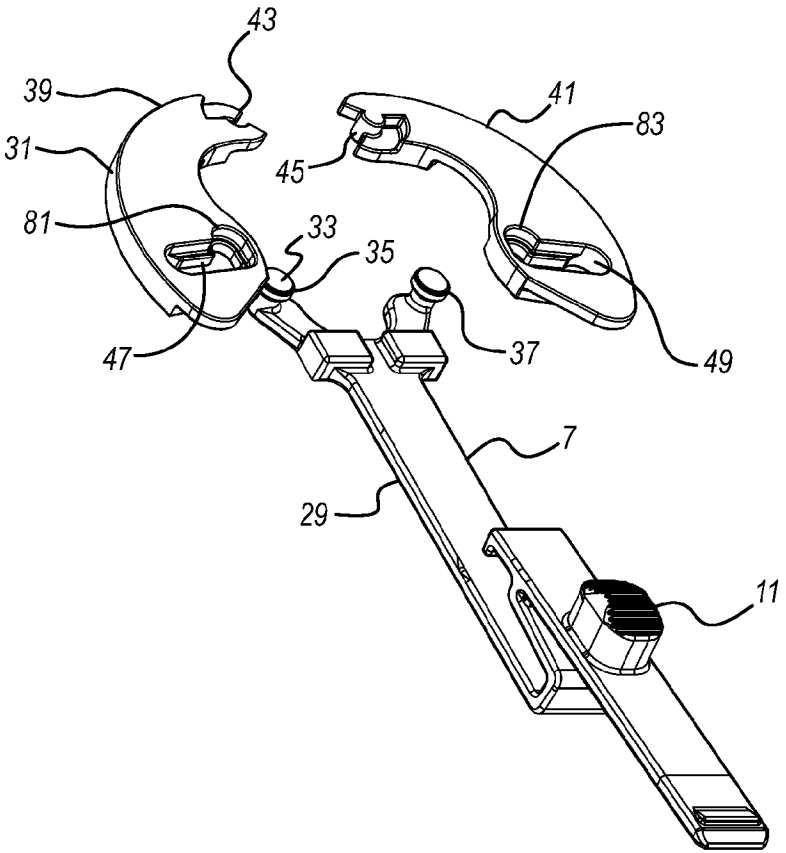
FIG. 4 is a front perspective exploded view of a guard assembly of a preferred embodiment of a rotary cutter of the present invention.

Referring further to FIG. 2 and FIG. 3, a guard stem 29 and a blade guard 31 of a preferred embodiment of the guard assembly 7 are shown. Referring also to FIG. 4, a front perspective exploded view of the guard assembly 7 is shown. The guard stem 29 has a pair of stem knobs 33, a left stem knob 35 and a right stem knob 37. The blade guard 31 has a left guard 39 and a right guard 41. For the embodiment shown, the left guard has a female joint socket 43 for mating with the male joint socket 45 of the right guard 41 as shown in FIG. 5, to form a guard pivot joint 53. FIG. 5 shows a fully assembled guard assembly 7 with the blade guard 31 secured to the guard stem 29 by insertion of the left stem knob 35 in the left guard track 47 and insertion of the right stem knob 37 in the right guard track 49.

Figure 6:
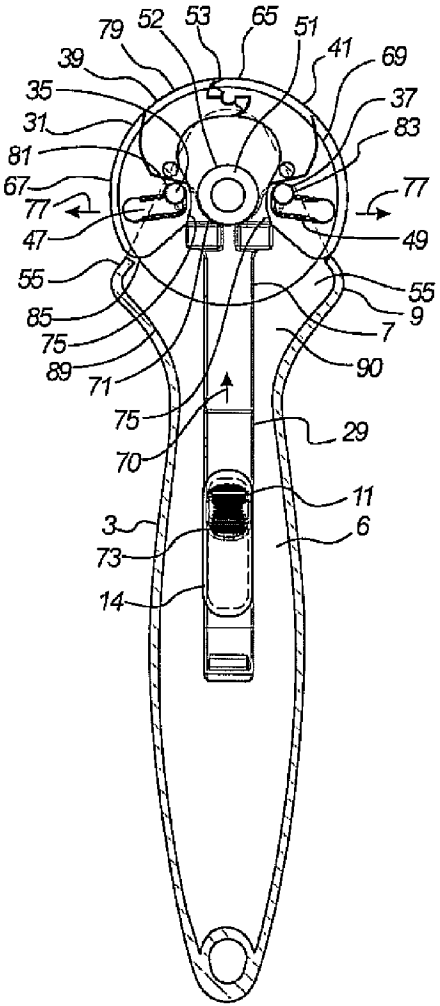
FIG. 6 is a front view longitudinal cross section detail of a preferred embodiment of a rotary cutter of the present invention showing the guard assembly positioned in the handle with the blade guard in the guard configuration.

Referring now to FIG. 6, the front view cross section detail showing the guard assembly 7 positioned in the handle 3 with the blade guard 31 in the guard configuration 65 which provides for the guard perimeter 67 to extend beyond the rotary blade perimeter 69 also shown in FIG. 2. Referring also to FIG. 1, as the user slides the slide knob 11 upwardly in the slide knob groove 12, which extends through the handle shell 4 from the handle interior surface 90 to the handle exterior surface 92, to the slide knob guarded position 73, the inside surface 75 of the left guard and the right guard respectively contact the bolt sleeve collar 51, which projects from and is an interior surface feature 52 and a part of the handle interior surface 90, and which rotates the left guard and the right guard respectively outwardly, effecting guard expansion 77, the left guard 39 and the right guard 41 pivoting with respect to each other at the guard pivot joint 53. The guard stem 29 slides in a stem track 14 in the handle cavity 6. Guard stem upward movement 70 of the guard stem 29 is limited by contact of the guard stem top 71 with the bolt sleeve collar 51 which extends from the handle interior surface 90 of the handle rear 55.

Figure 7:
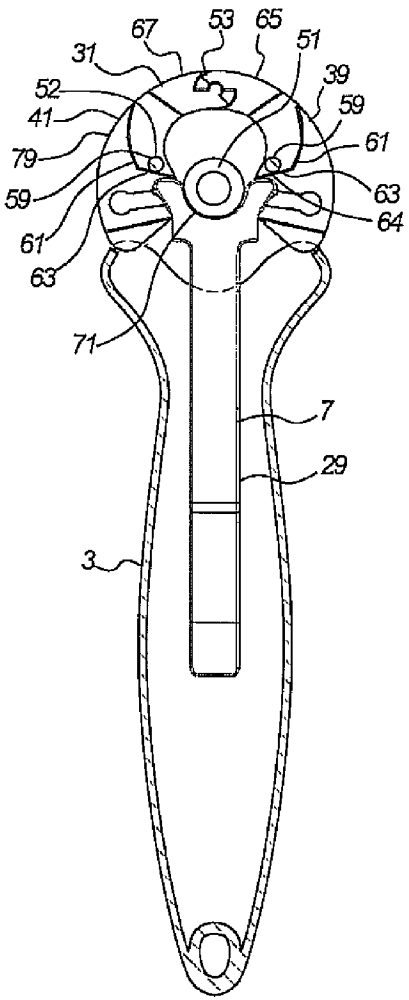
FIG. 7 is a rear view longitudinal cross section detail of a preferred embodiment of a rotary cutter of the present invention showing the guard assembly positioned in the handle with the blade guard in the guard configuration.

Referring also to FIG. 7 which is a rear cross section detail of the guard assembly 7 in place in the handle 3, the left guard and the right guard are further urged to the guard's secure configuration 79 with the left stem knob 35 positioned in the left track notch 81 and the right stem knob 37 positioned in the right track notch 83 by the guard pegs 59, which are interior surface features 52 of the handle interior surface 90 and extend from the handle rear 55 of the handle interior surface 90 and press on the rear track bases 63 of the rear guard track 61, the rear track bases 63 having a rear track base slope 64, further urging the guard expansion 77 as the guard assembly is moved to the guard configuration 65. Referring now to FIG. 6. The positioning of the stem knobs 35, 37 in their respective guard track notches 81, 83, provides additional resistance and security of the guard against retraction in the event of inadvertent pressure against the guard.

Referring further to FIG. 6, as the user begins sliding the slide knob 11 in the slide knob groove 12 down toward the slide knob unguarded position 74, to retract the blade guard, the first movement of the guard stem 29 results in the movement of the stem knobs 35, 37 from the guard track notches 81, 83. Further downward movement of the guard stem results in downward movement of the blade guard 31 as well. The downward movement of the blade guard results in the contact of the left guard base 85 with the left handle shoulder 89 of the handle interior surface 90 and the right guard base 87 with the right handle shoulder 91 of the handle interior surface 90.

Figure 8:
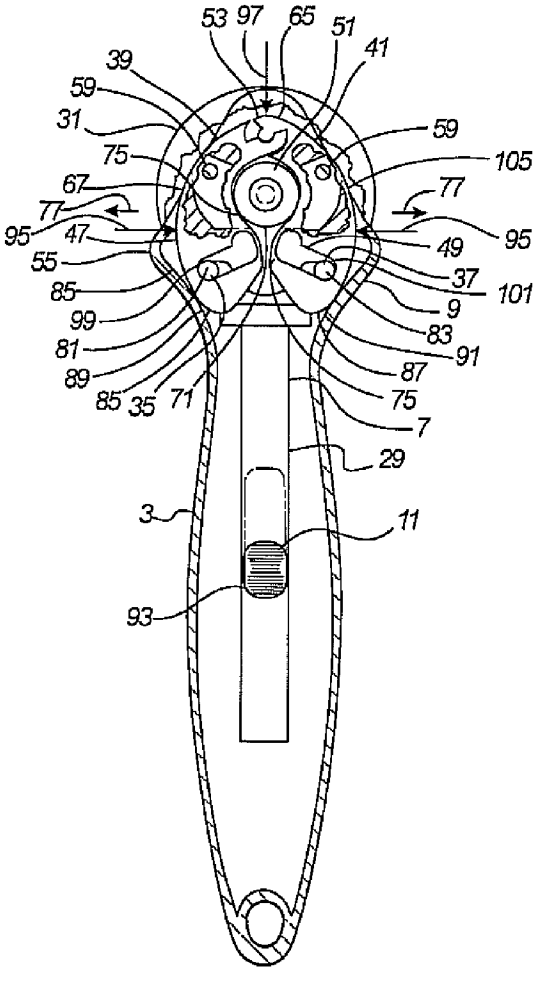
FIG. 8 is a front view longitudinal cross section detail of a preferred embodiment of a rotary cutter of the present invention showing the guard assembly positioned in the handle with the blade guard in the guard fully retracted configuration.

Referring now to FIG. 8, further downward movement of the slide knob 11 and hence the guard stem 29 to the fully retracted position 93 results in the lateral retraction 95 as well as the longitudinal retraction 97 of the blade guard 31. The contact between the left guard base 85, the left handle shoulder 89 between the right guard base 87 and the right handle shoulder 91 results in the pivoting of the left guard 39 and the right guard 41 at the guard pivot joint 53, and the movement of the left stem knob 35 in the left guard track 47 to the left track end 99 and the movement of the right stem knob 37 in the right guard track 49 to the right track end 101.

Figure 9:
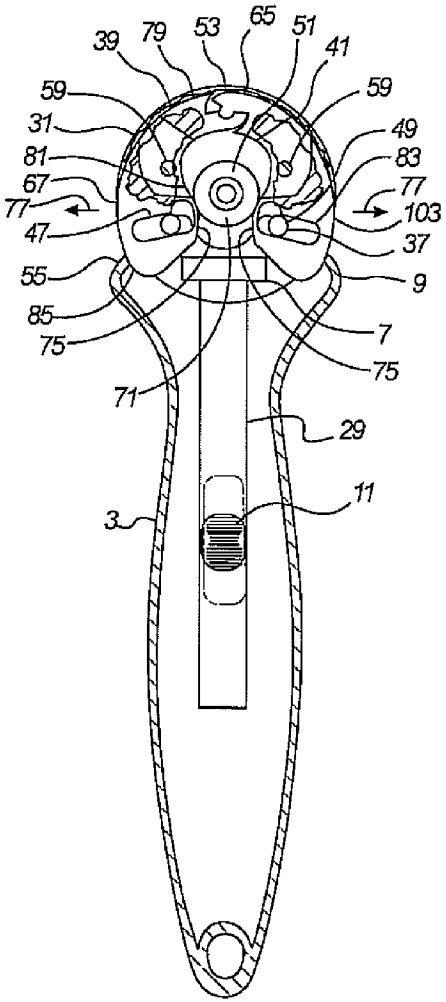
FIG. 9 is a front view longitudinal cross section detail of a preferred embodiment of a rotary cutter of the present invention showing the guard assembly positioned in the handle with the blade guard in a guard partially retracted configuration.

Referring to FIG. 9, the guard assembly 7 is shown in a guard partial retraction 103 configuration which illustrates the configuration of the guard assembly 7 either during downward operation by the user of the slide knob 11, transforming the blade guard 31 from the guard configuration 67 shown in FIG. 6 to the guard retracted configuration 105 shown in FIG. 8 or the upward sliding of the slide knob 11, transforming the blade guard 31 from the guard retracted configuration 105 shown in FIG. 8 to the guard configuration 67 shown in FIG. 6.

Figure 10:
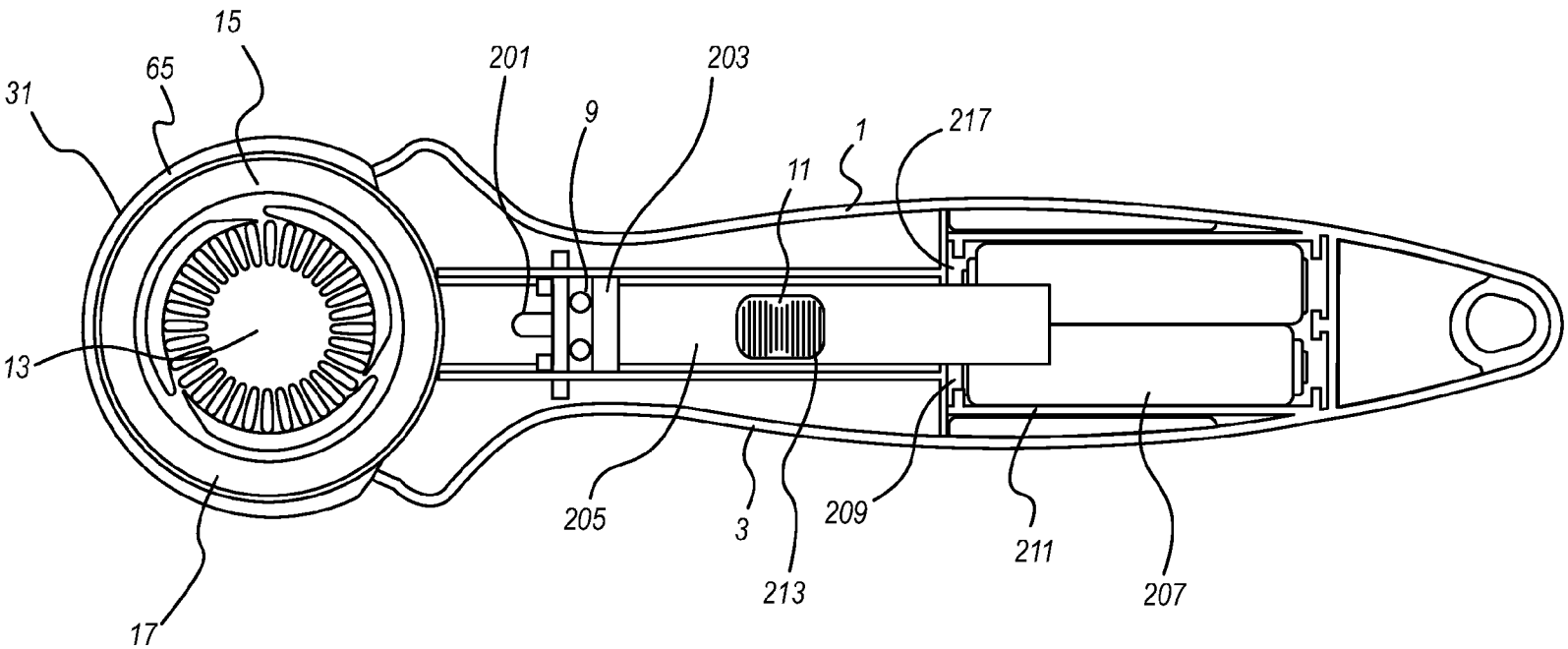
FIG. 10 is a front longitudinal cut-away view of a preferred embodiment of the rotary cutter of the present invention in the guard configuration showing a light assembly which may be incorporated in the rotary cutter.
Figure 12:
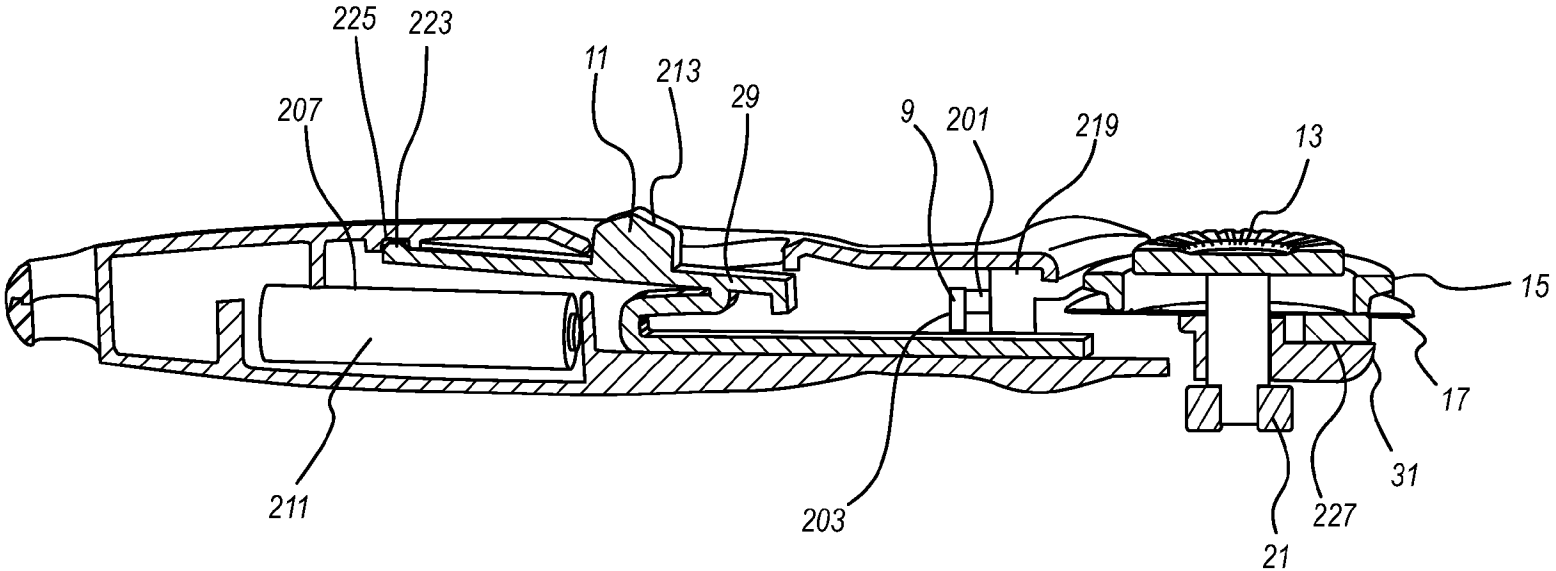
FIG. 12 is a longitudinal side cross-section view of a preferred embodiment of the rotary cutter of the present invention in the guard configuration showing a light assembly which may be incorporated in the rotary cutter.

Referring now to FIG. 10, a front cut-away view, and to FIG. 12, a longitudinal cross section, of the preferred embodiment of the rotary cutter 1 of the present invention showing the light assembly 9 which may be incorporated in the rotary cutter 1. The primary components of this preferred embodiment of the light assembly 9 are a light element 201 which, based upon current technology, is preferably an LED; an electric switch 203 for the light element 201; a mechanical switch 205 engaged by the user to activate and deactivate the electric switch 203 and thereby turn the light element 201 on and off; a power source 207; and electrical interconnection 209 such as power leads 217, between the power source 207, the electric switch 203 and the light element 201. The light assembly 9 is generally housed in the handle cavity 6. For the embodiment shown the power source is a battery pack 211 with replaceable batteries built into the handle cavity 6 of the cutter handle 3, which may be rechargeable.

Figure 11:
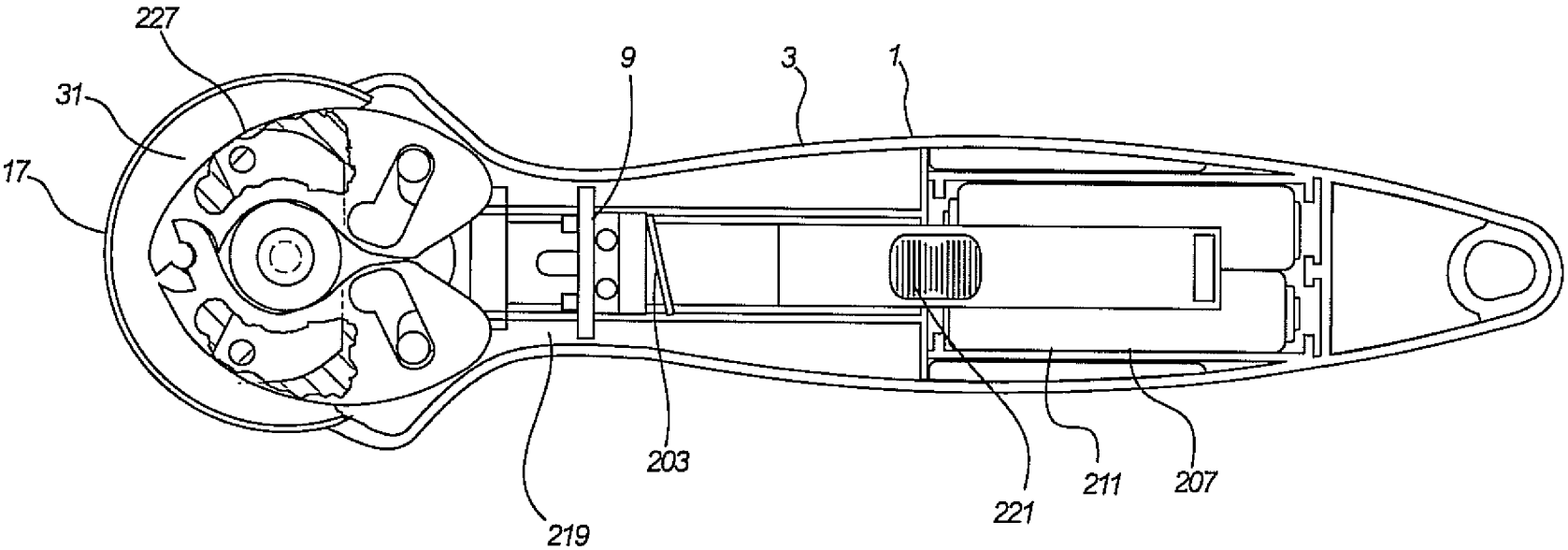
FIG. 11 is a front longitudinal cut-away view of a preferred embodiment of the rotary cutter of the present invention in the guard fully retracted configuration showing a light assembly which may be incorporated in the rotary cutter.

Referring also to FIG. 11, the mechanical switch 205 incorporates the slide knob 11 which, when slid by the user from the light off position 213, which is also the position of the slide knob 11 when the blade guard 31 is in the guard configuration 65, causes the electric switch 203 to electrically connect the battery pack 211 to the light element 201 through the electrical interconnection 209, thereby providing power to the electric switch 203 turning the switch on and thereby energizing the light element 201. Alternative means of providing power to the electric switch and thus to the light element, such as an internally rechargeable battery pack, remote battery pack, or a power cord, will be known to persons of ordinary skill in the art. Further, alternative mechanical switches, electric switches and light elements will be known to persons of ordinary skill in the art.

Referring also to FIG. 12, when the slide knob 11 has been slid by the user to the knob retracted position 221, the guard stem tip 223, of the guard stem 29, engages the guard stem lock 225, thereby locking the blade guard 31 in the guard retracted configuration 227.

An important feature of the light assembly 9 of this embodiment of the present invention is the positioning of the light element 201 in the blade and guard chamber 219 of the handle such that light emitted from the light element emanates to the fabric surface that the user intends to cut when the cutter is placed by the user in the normal cutting position. With the light element 201 in this preferred position, light emanates to the fabric surface, regardless of which hand the cutter is being held in by the user and regardless of which side of the cutter is nearest the fabric during the cutting operation. This preferred position of the light element 201 also protects the light element from damage during the cutting operation.

An additional safety benefit can also be achieved through the addition of a transparent or translucent blade guide 15 on the blade bolt 13. Light emitted from the light element 201 illuminates the blade guide 15 which transmits and disburses some of the light emitted by the light element, thereby providing a visible warning to the user that the guard has been retracted. Further safety features may be incorporated, such as a motion sensor, timing element and a flasher, providing for the light element to blink on and off if certain events occur, such as the light element having been left energized for a pre-determined time interval and no movement of the rotary cutter having occurred for a selected time interval, indicating that the cutter may have been set aside with the guard retracted and the light element energized. This will serve to warn the user and others that perhaps the guard should be extended and the light element de-energized.

Figure 14:
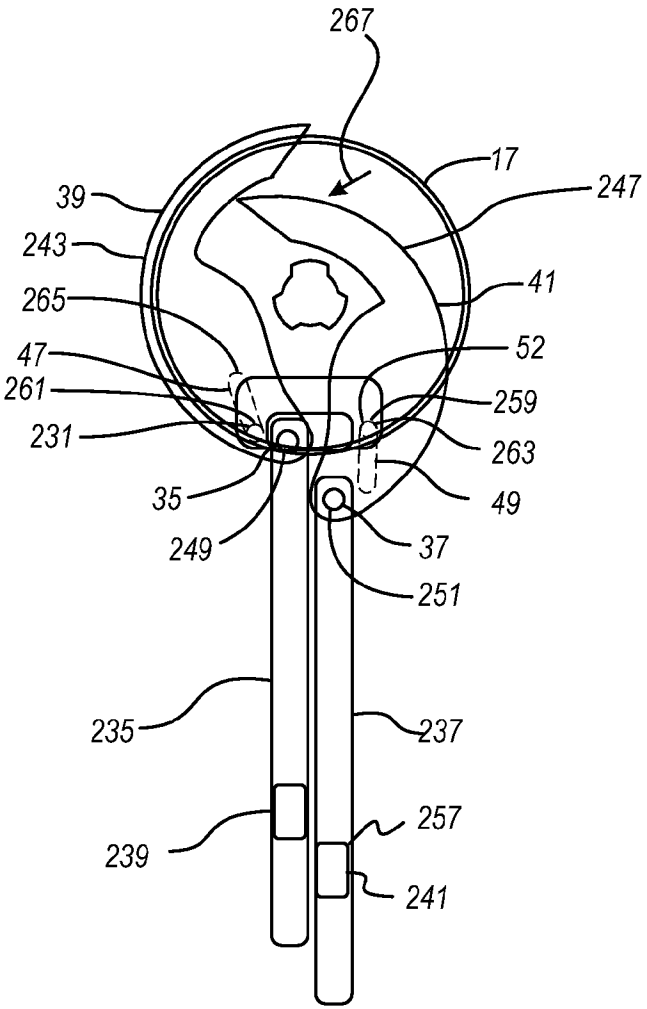
FIG. 14 is a front view detail of a guard assembly of an alternative preferred embodiment of a rotary cutter of the present invention in a guard fully retracted reconfiguration, this embodiment providing for retraction of one side of the guard.
Figure 13:
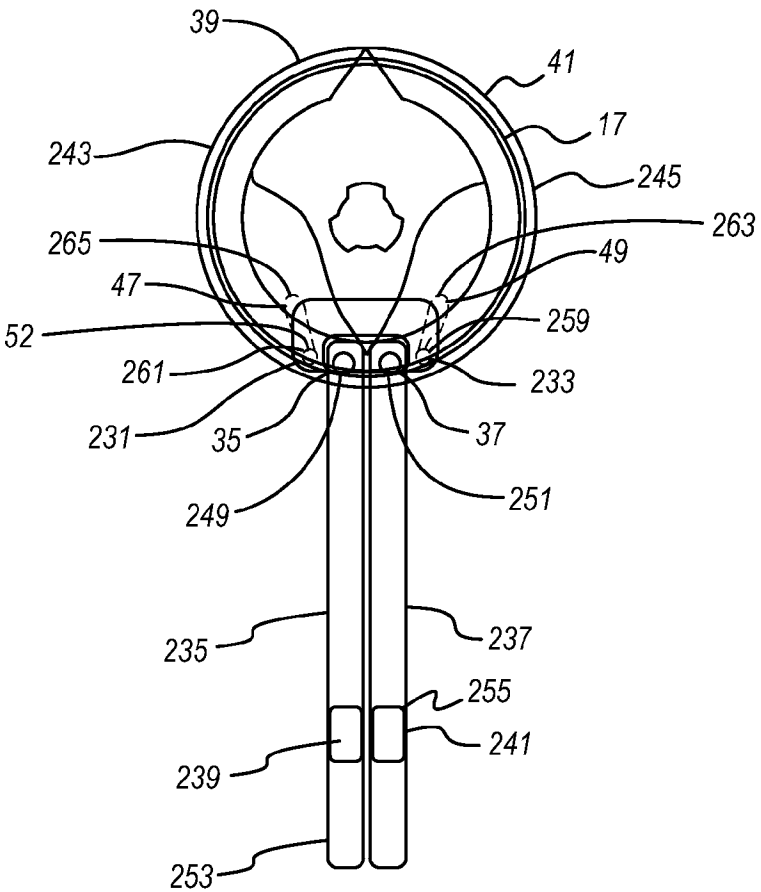
FIG. 13 is a front view detail of a guard assembly of an alternative preferred embodiment of a rotary cutter of the present invention in a guard configuration, this embodiment providing for retraction of one side of the guard.

Referring now to FIG. 13, an alternative embodiment of the rotary cutter 1 of the present invention has a guard stem pair 253, a left guard stem 235 and a right guard stem 237, the left guard stem 235 being pivotally connected to the left guard 39 by the left stem knob 35 in a left stem knob joint 249 and the right guard stem 237 being pivotally connected to the right guard 41 by the right stem knob 37 in a right stem knob joint 251. The left stem knob joint 249 provides for the pivoting of the left guard 39 with respect to the left guard stem 235 and the right stem knob joint 251 provides for the pivoting of the right guard 41 with respect to the right guard stem 237. Referring also to FIG. 14, for this embodiment, as the right slide knob 241 is slid from the right slide knob guard extended position 255 to the right slide knob guard retracted position 257, the right guard track 49 slides upon the right guard peg 259 from the right guard peg extended position 233 to the right guard peg retracted position 263, providing for the downward and inward movement 267 of the right guard 41 from a right guard extended configuration 245 to a right guard retracted configuration 247. Corresponding sliding of the left slide knob 239 causes the left guard track 47 to slide upon the left guard peg 261 from the left guard peg extended position 231 to the left guard peg retracted position 265, providing for the downward and inward movement of the left guard 39 from a left guard extended configuration 243 to a left guard retracted configuration. As with the previous embodiments described, the guard pegs, the right guard peg 259 and the left guard peg 261, are interior surface features 52 of the handle interior surface 90 and extend from the handle rear 55 of the handle interior surface 90. This alternative embodiment allows the user to expose only one side of the blade at a time.

Figure 16:
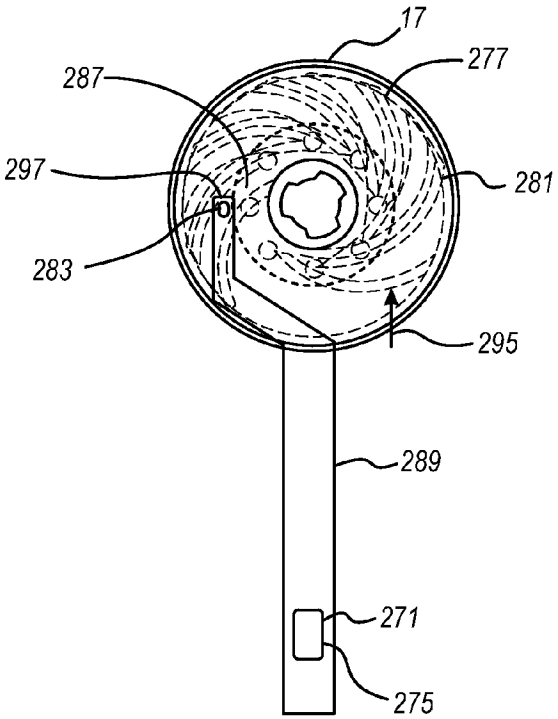
FIG. 16 is a front view detail of a guard assembly of an alternative preferred embodiment of a rotary cutter of the present invention having a spiral guard, in a guard retracted configuration.
Figure 17:
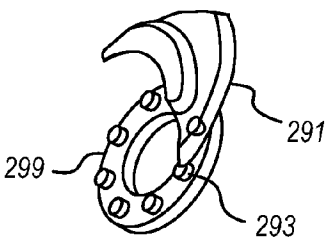
FIG. 17 is a front perspective view detail of a guard anchor disk and spiral guard elements of an alternative preferred embodiment of a rotary cutter of the present invention having a spiral guard.
Figure 15:
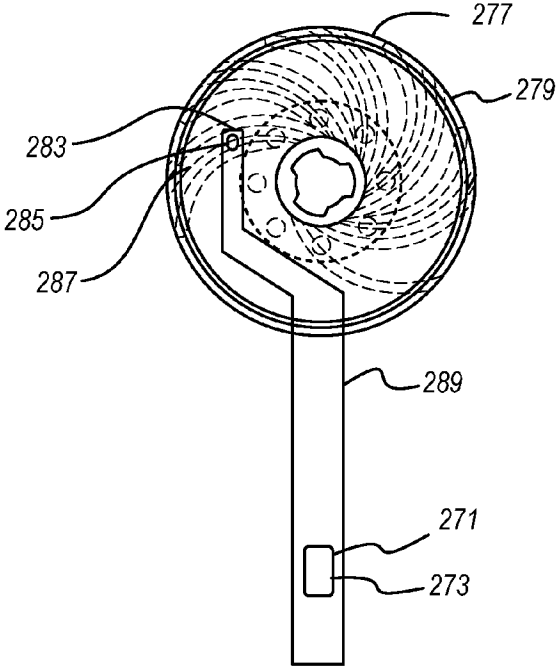
FIG. 15 is a front view detail of a guard assembly of an alternative preferred embodiment of a rotary cutter of the present invention having a spiral guard, in a guard configuration.

Referring now to FIG. 15, a further alternative embodiment of the rotary cutter of the present invention has a spiral configuration guard 277 which retracts and extends spirally. For this embodiment, as the slide knob 271 of the guard stem 289 is slid from the slide knob guard extended position 273 to the slide knob guard retracted position 275 as shown in FIG. 16, the stem knob 283 slides in the guard track 287 from the stem knob guard extended position 285 to the stem knob guard retracted position 297 in the guard track 287. Referring also to FIG. 17, this causes each of the spiral guard segments 291 to rotate inward 295, each of the spiral guard segments 291 pivoting with respect to the guard anchor disk 299 on an anchor disk knob 293, and causes the spiral configuration guard 277 to transition from an guard extended configuration 279 to a guard retracted configuration 281 by spiral retraction. The guard anchor disk 299 may be attached to the handle interior surface 90.

Other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A hand-held, rotary fabric cutter comprising:

a cutter handle having a handle interior surface and a handle exterior surface;

a blade bolt;

a rotary blade attached to the handle by the blade bolt;

a longitudinally and laterally retractable blade guard attached to the handle by the blade bolt, the blade guard having a right guard and a left guard, the right guard and the left guard being pivotally connected by a guard pivot joint; and a slide knob projecting from the handle through a slide knob groove, the slide knob being connected to the right and left guards and the slide knob providing for a user to retract and extend the blade guard longitudinally and laterally by sliding the slide knob in the slide knob groove, the guard pivot joint and contact of the blade guard with the handle interior surface providing for the longitudinal and lateral retraction and extension of the right guard and the left guard as the user slides the slide knob between a slide knob guarded position and a slide knob unguarded position.

2. The hand-held, rotary fabric cutter recited in claim 1 further comprising a light assembly which comprises a light element, an electric switch for the light element, a power source, and electrical interconnection between the power source, the electric switch and the light element, the electric switch being engaged by the slide knob to activate and deactivate the electric switch to turn the light element on and off as the slide knob is slid by the user from the slide knob guarded position and the slide knob unguarded position.

3. The hand-held, rotary fabric cutter recited in claim 2 further comprising a blade guide attached to the cutter handle by the blade bolt, the blade guide being transparent or translucent.

4. A hand-held, rotary fabric cutter comprising:

a cutter handle having a handle interior surface and a handle exterior surface;

a blade bolt;

a rotary blade attached to the handle by the blade bolt;

a longitudinally and laterally retractable blade guard attached to the handle by the blade bolt, the blade guard having a right guard and a left guard, the right guard and the left guard being pivotally connected by a guard pivot joint;

a slide knob projecting from the handle through a slide knob groove, the slide knob being connected to the right and left guards and the slide knob providing for a user to retract and extend the blade guard longitudinally and laterally by sliding the slide knob in the slide knob groove, the guard pivot joint and contact of the blade guard with the handle interior surface providing for the longitudinal and lateral retraction and extension of the right guard and the left guard as the user slides the slide knob between a slide knob guarded position and a slide knob unguarded position; and a light assembly which comprises a light element, an electric switch for the light element, a power source, and electrical interconnection between the power source, the electric switch and the light element, the electric switch being engaged by the slide knob to activate and deactivate the electric switch to turn the light element on and off as the slide knob is slid by the user between the slide knob guarded position and the slide knob unguarded position.

5. The hand-held, rotary fabric cutter recited in claim 4 further comprising a blade guide attached to the cutter handle by the blade bolt, the blade guide being transparent or translucent.

6. A hand-held, rotary fabric cutter comprising:

a cutter handle having a handle interior surface and a handle exterior surface;

a blade bolt;

a rotary blade attached to the handle by the blade bolt;

a retractable blade guard attached to the handle by the blade bolt;

a slide knob projecting from the handle through a slide knob groove, the slide knob being connected to the blade guard and the slide knob providing for a user to retract and extend the blade guard by sliding the slide knob between a slide knob guarded position and a slide knob unguarded position; and a light assembly which comprises a light element, an electric switch for the light element, a power source, and electrical interconnection between the power source, the electric switch and the light element, the electric switch being engaged by the slide knob to activate and deactivate the electric switch to turn the light element on and off as the slide knob is slid by the user from the slide knob guarded position and the slide knob unguarded position.

7. The hand-held, rotary fabric cutter recited in claim 6 further comprising a blade guide attached to the cutter handle by the blade bolt, the blade guide being transparent or translucent.

8. A hand-held, rotary fabric cutter comprising:

a cutter handle having a handle interior surface and a handle exterior surface;

a blade bolt;

a rotary blade attached to the handle by the blade bolt;

a longitudinally and laterally retractable blade guard attached to the handle by the blade bolt, the blade guard having a right guard and a left guard; and a pair of slide knobs, a right slide knob and a left slide knob, projecting from the handle through one or more slide knob grooves, the right slide knob being connected to the right guard and the left slide knob being connected to the left guard, the slide knobs providing respectively for a user to retract and extend the blade guard longitudinally and laterally by sliding the slide knobs in the slide knob groove, contact of the right guard with the handle interior surface providing for the longitudinal and lateral retraction and extension of the right guard and contact of the left guard with the handle interior surface providing for the longitudinal and lateral retraction and extension of the left guard, as the user slides one the respective slide knobs between a slide knob guarded position and a slide knob unguarded position.

9. A hand-held, rotary fabric cutter comprising:

a cutter handle having a handle interior surface and a handle exterior surface;

a blade bolt;

a rotary blade attached to the handle by the blade bolt;

a spiral retractable blade guard; and a slide knob projecting from the handle through a slide knob groove, the slide knob being connected to the blade guard and the slide knob providing for a user to retract and extend the blade guard spirally by sliding the slide knob in the slide knob groove between a slide knob guarded position and a slide knob unguarded position.

* * * * *